United States Patent [19]

Thornton

[11] 4,162,649

[45] Jul. 31, 1979

[54] SHEET STACK DIVIDER

[75] Inventor: John N. Thornton, Huntingdon, England

[73] Assignee: Wiggins Teape Limited, Hampshire, England

[21] Appl. No.: 797,915

[22] Filed: May 18, 1977

[51] Int. Cl.[2] ..... B31B 1/98

[52] U.S. Cl. ..... 93/93 D; 414/131; 271/218; 414/37

[58] Field of Search ..... 93/93 D, 93 DP; 214/8.5 SS, 8.5 K; 271/189, 218

[56] References Cited

U.S. PATENT DOCUMENTS

| | | | |
|---|---|---|---|
| 2,122,710 | 7/1938 | Bidwell et al. | 93/93 D |
| 2,619,883 | 12/1952 | Andren | 93/93 D |
| 2,853,299 | 9/1958 | Link et al. | 271/218 X |
| 3,362,707 | 1/1968 | Lauren | 271/218 |
| 3,883,131 | 5/1975 | Anderson, Jr. et al. | 271/218 X |
| 3,892,168 | 7/1975 | Grobman | 93/93 DP X |
| 3,960,374 | 6/1976 | Gaffney | 271/218 X |

*Primary Examiner*—Roy Lake
*Assistant Examiner*—Paul A. Bell
*Attorney, Agent, or Firm*—Imirie, Smiley & Guay

[57] ABSTRACT

A layboy mechanism for the continuous stacking and delivery of batches of sheet material received from a delivery mechanism and comprising means for continuously receiving cut sheets and forming them into a downwardly moving stack, divider means for dividing the stack into batches containing a predetermined number of sheets, and means for removing the lowermost batch while the remainder of the stack above it is supported by auxiliary support means which move between an operative support position and an inoperative position clear of the stack.

17 Claims, 10 Drawing Figures

SHEET STACK DIVIDER

This invention relates to a device used for the purpose of gathering and stacking sheet material, for example paper, board, or cardboard. Such a device is usually known as a layboy and will hereinafter be referred to as such.

Heretofore when sheets, particularly of paper, have been collected in succession as they issue from a machine for example a sheeting machine, this has usually been done by one or other of two conventional systems one of which comprises gripper fingers which grip the sheets and pull them to a pre-determined location at which the grippers release the sheets in a manner such that successive sheets form a vertical, or nearly vertical, stack which is constrained by fences to keep the stack tidy. The other system comprises the use of a conveyor or pinch rolls so driven as to project successive sheets into a fenced area to keep the stack formed therein tidy.

With such conventional systems the pattern of sheet delivery to a layboy may be one of several kinds, for example, with a system using gripper fingers these may be arranged to carry one sheet or a plurality of sheets, and with a system using a conveyor or pinch rolls the sheets, delivered either singly or as a batch of superimposed sheets, may be arrested by known means operable to engage the trailing end of a sheet or batch, or the sheets or batches may be delivered in echelon or shingled fashion, or a pre-collection device may be used to form mini-stacks containing, for example, ten sheets, such mini-stacks being delivered to the layboy.

With all such systems some form of mechanism is required to accomodate the growing stack in the layboy and this is usually effected in one or other of two ways. In one such way a delivery unit is raised in concert with the growing stack and in the other, which is that more usually employed, the sheets are collected on a platform or table which descends at the growing rate of the stack.

Whatever system is employed there comes a time when the stack must be removed and this is a problem which has exercised the minds of those in the art for many years. The first, and most obvious, method is that of stopping the machine, unloading the stack, returning the collecting platform to the initial delivery height, and then re-starting the machine. However, with this method, apart from the loss of production time which is entailed thereby, the deceleration and acceleration periods for stopping and starting often cause indifferent machine performance which can be manifested in the product.

If the machine is a slow operating machine, or can be slowed down to an acceptable deficiency in product or scrap rate, it is common practice to interrupt the flow of sheets into the layboy by means of a temporary receiver which holds back the supply of sheets to the layboy and collects sheets while a stack is being removed from the layboy. In some instances the temporary receiver has the form of a pile board which remains in position until the layboy collecting platform is returned to its starting position, the pile board then being released to move downwards with the platform. In other instances the temporary receiver has the form of a roller shutter which is wound over the layboy stack to interrupt the receipt of sheets by the layboy, the shutter being retracted when a stack has been removed from the layboy and the receiving platform returned to its starting position.

It has also, in recent years, been proposed to deliver from a machine, particularly when the sheets are of relatively small size such as sheets of office stationery and systems papers, small stacks containing a predetermined number of sheets, for example stacks containing a ream. This has been effected by duplicating the delivery and layboy mechanisms and switching the flow of sheets to alternate layboys at a predetermined count.

It is a main object of the present invention to provide a layboy capable of continuously collecting a stack, in the form of a number of batches containing a predetermined number of sheets, which are formed one on another, and removing the batches without interruption of the stack formation.

According to the present invention a layboy mechanism for the continuous stacking and delivery of batches of sheet material received from a delivery mechanism comprises means for continuously receiving cut sheets and forming them into a stack, divider means for dividing the stack into batches containing a predetermined number of sheets, and means for removing the lowermost batch whilst the remainder of the stack above it is supported by auxiliary support means which move between an operative support position and an inoperative position clear of the stack.

Preferably the stack is formed on a support table reciprocable from an initial upper position at which the table is engagable with the bottom of the stack and a lower position from which the lowermost batch is removed, whilst the remainder of the stack is supported by the auxiliary support means.

The said auxiliary support means may be arranged to enter the stack at a point between the lowermost batch and the next batch above it, an opening between the batches being provided by operation of the divider means.

With this form of mechanism sheets can be delivered in substantially horizontally into a receiver formed by vertical fences which are vibrated or jogged to maintain the edge register of the growing stack. The vertically reciprocable support table may form the floor to the fenced area and be arranged to travel downward at the same rate as the stack growth within the fenced area, thereby maintaining a constant delivery height into the fenced area. The downward travel of the support table is preferably related to the sheet feeding machinery in such a manner that delivery speed changes will automatically alter the descent rate of the support table.

In a preferred arrangement said layboy mechanism comprises a sheet receiver in which sheets are superimposed and stacked on a support table reciprocable to and from an initial position at which the table is engageable with the bottom of a stack contained in the receiver and a position directly below and in line with the receiver and from which a stack removed from the receiver is unloaded from the table, a divider element containing magazine, divider element feeding and withdrawing means operable to move a divider element from the magazine, to position it on the top of a stack contained in the receiver to define a batch having a predetermined number of sheets, and to return it to the magazine when the stack below it has been lowered from the receiver by the table, and auxiliary stack-supporting member reciprocable to and from a position at which it engages and supports the stack formed of batches in the receiver while the table is being moved from a receiver to the unloading position and is returned to the initial position thereof, and actuating means operable to control operation of the support table, the divider element feeding and withdrawing means, and the auxiliary stack-supporting member in response to signals from a sheet counter device arranged to count sheets being delivered to the receiver, said actuating means being arranged while the support table and the auxiliary stack-supporting member respectively act as the support for sheets delivered to the receiver to permit downward movement of said table and member at the rate at which sheets are received by the receiver.

The invention will now be described, by way of example, with reference to the accompanying drawings in which.

Before describing the mechanism in detail a brief description of the mode of operation thereof will be given with reference to FIGS. 7, 8, 9 and 10.

Figure 10:
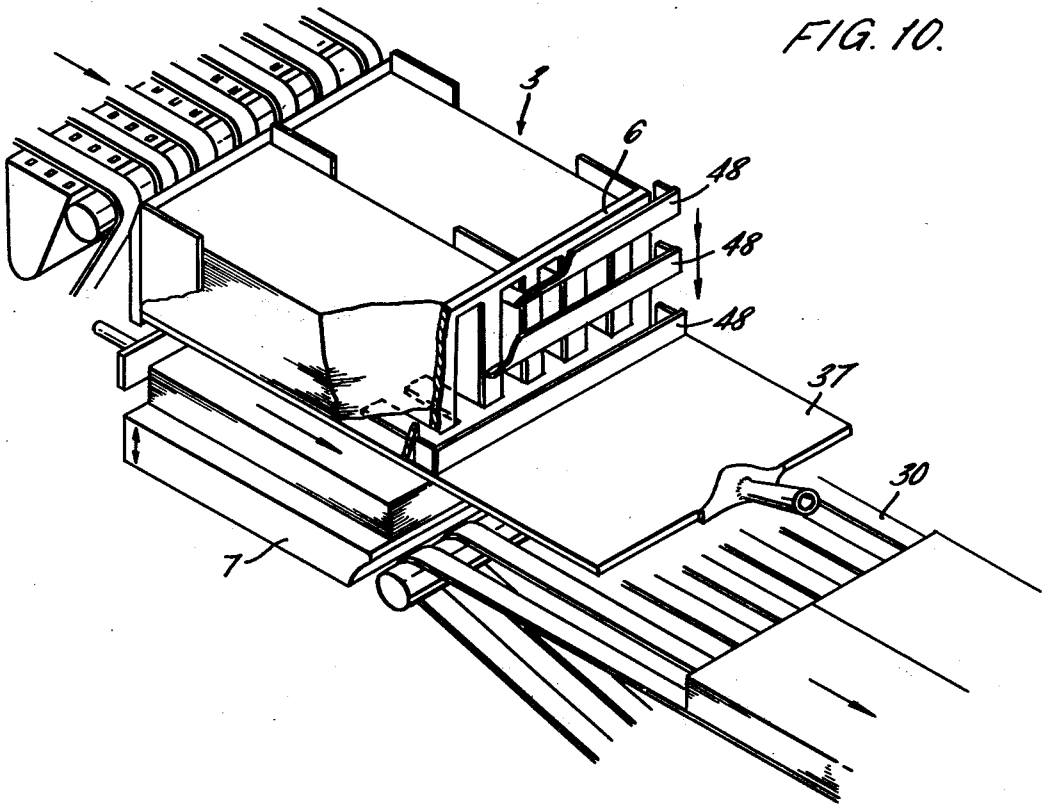

Sheets are delivered, for example by means of the conveyor shown in FIG. 10 through a vacuum box and padder to the top of a stack receiver the lower supporting surface of which is provided by a support table 7 which moves downwardly at the stack growth rate. To record the arrival of a predetermined fixed number of sheets onto the stack receiver a horizontally located divider 48 is impelled from a magazine 46 containing a number of dividers 48, onto the top of the stack of sheets at the correct count to provide a batch of, for example, a ream, between the arrival of successive sheet deliveries. One fence 6 of the stack receiver is in the form of vertical rails, as is more clearly shown in FIG. 10, and the dividers 48 are in the form of a comb, the tines or fingers of which can project between the fence rails and into the stack within the receiver 3. The continuing downward movement of the stack carries the dividers 48 in a downward direction with it.

The count-recording divider insertion device can be initiated by, for example, automatically counting the cuts of a sheet cutting machine or the number of impressions from a printing machine.

Figure 7:
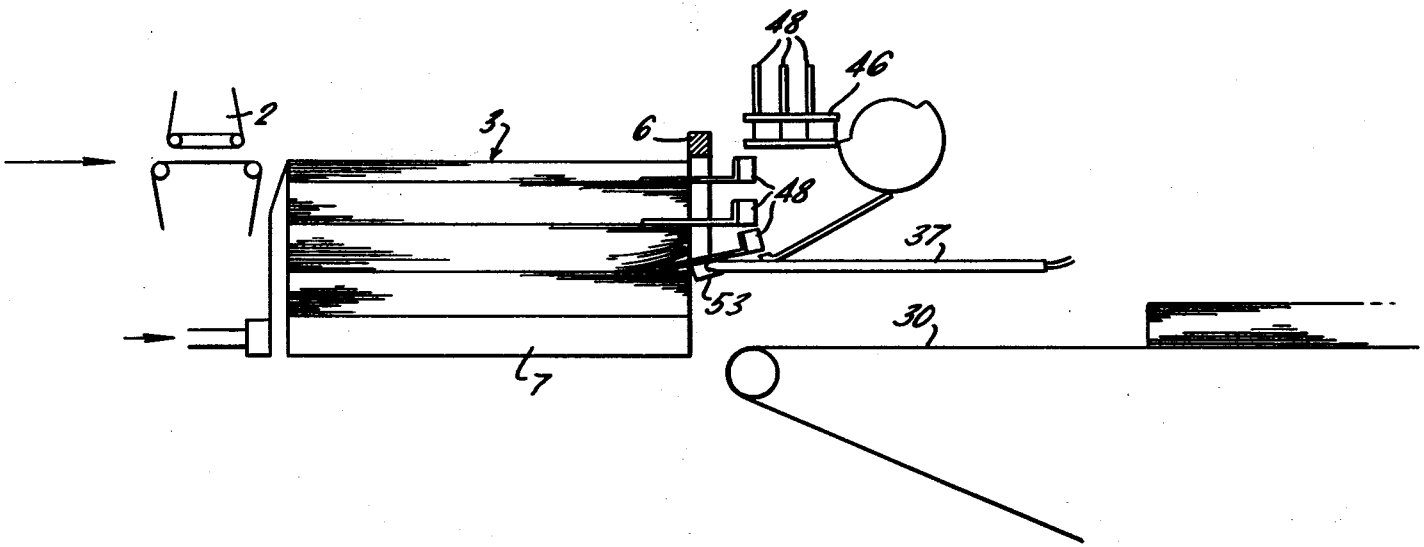
FIGS. 7, 8, 9 and 10 are diagrammatic representations of the machine illustrating various positions of the parts during operation.
Figure 8:
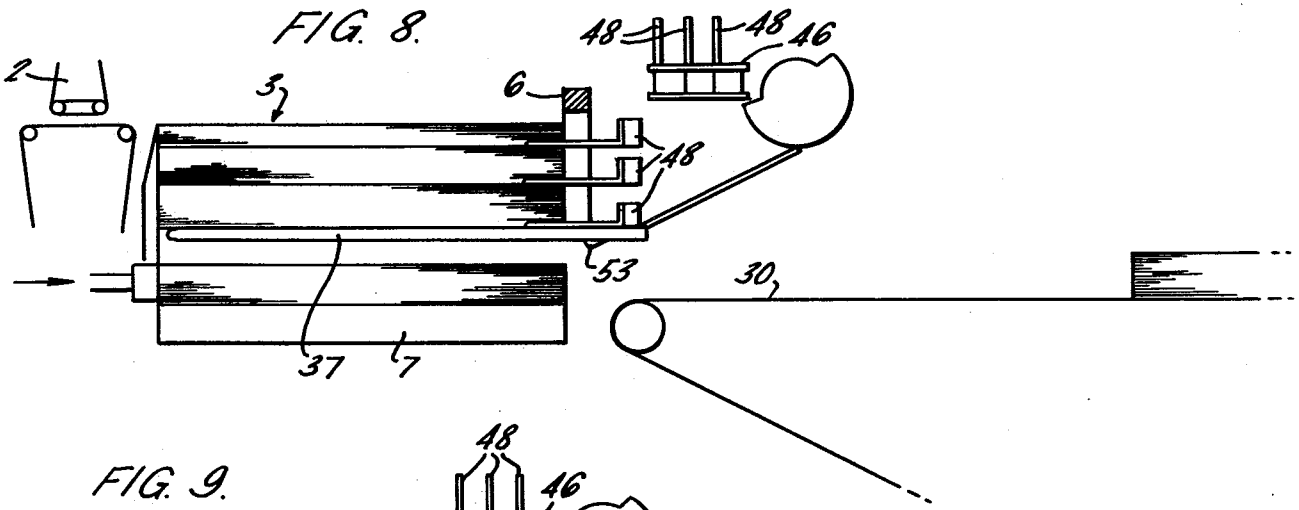
Figure 9:
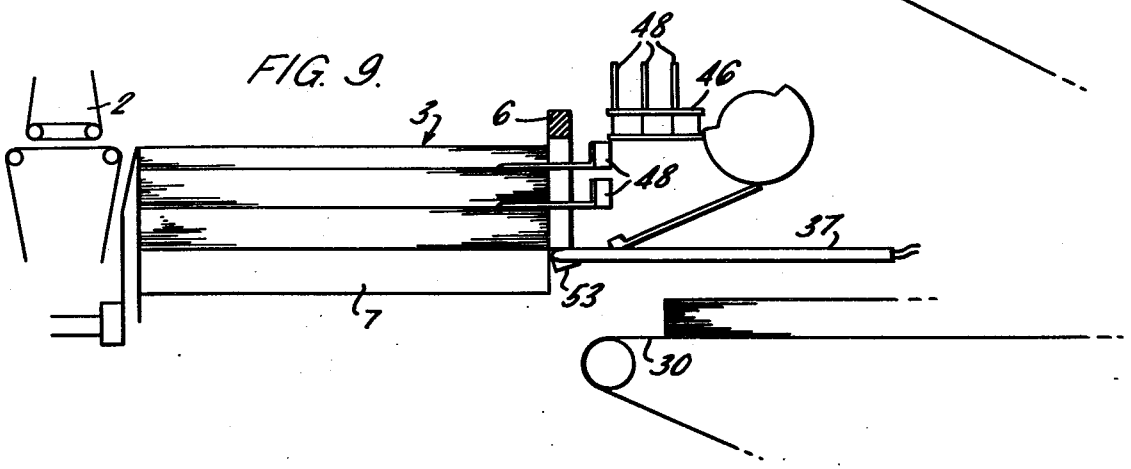

The lower end of the fence 6 is bridged by a cross head 53 and at this point, further downward movement of the divider 48 is prevented because the fingers of the divider are arrested by the cross head as is most clearly shown in FIG. 7. Further downward movement of the stack however creates a wedge shaped gap in the side of the stack in the region of the divider and this is the position of the various parts as shown in FIG. 7. A horizontal flat auxiliary sheet-support member 37 is provided which descends at the same rate as the stack growth and automatically penetrates the gap and completely divides the descending stack as shown in FIG. 8 thus enabling the batch containing a measured quantity of sheets below it to be divorced from the main stack within the stack receiver. As the auxiliary sheet support member penetrates the stack the divider 48 is retrieved and returned to the divider magazine 46. The support table 7 on which the batch is carried now descends rapidly to a discharge position away from the underside of the descending stack, as shown in FIG. 8, which is meanwhile supported by the auxiliary sheet support member 37. At the lowermost extend of travel of the support table 7 the batch of sheets is expelled from the table top onto a discharge conveyor 30. After discharging the batch the support table 7 is driven rapidly upwards to meet the underside of the descending auxiliary sheet support member 37. At this point the support table travel is reversed so that once again the table descends the stack growth rate. With the support table 7 in close proximity to the underside of the auxiliary sheet support member 37 the said member is withdrawn thus transferring the oncoming stack onto the support table 7 as shown in FIG. 9. After the complete withdrawal of the support member 37 the said member can be rapidly elevated to take up a position ready to divorce the next batch from the underside of the stack within the stack receiver 3.

In FIG. 10 the position of the various parts is similar to FIG. 8, that is the auxiliary sheet support member 37 is supporting the stack of sheets and descending but the support table 7 is at its lowermost position with the batch on it divorced from the rest of the stack and ready for ejection onto the conveyor 30.

Figure 1:
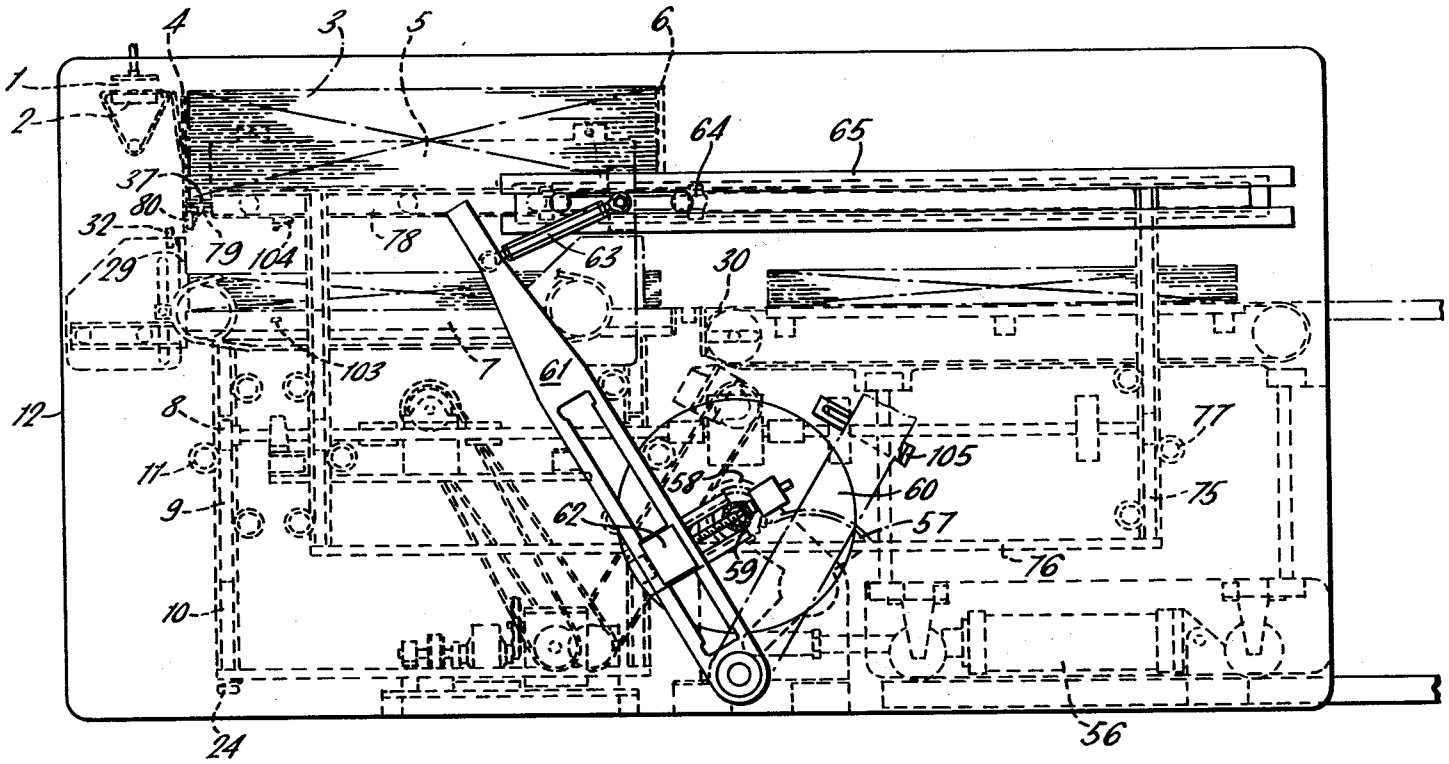
FIG. 1 is an elevation of a layboy according to the invention.

To now describe the invention in more detail, sheet product is fed in the direction of arrow 1, FIG. 1, and its velocity is reduced by the action of a vacuum box and padder 2, as described in British Patent Specification No. 1,136,421. However, other known methods of sheet delivery, e.g. gripper fingers or overlapping devices may be adopted as an alternative to the vacuum box and padder. According as to which kind of sheet delivery device is used, the sheet produce is either projected or carried in a substantially horizontal path onto the top of a stack receiver 3.

The receiver consists of fences 4, 5 and 6. There are two or more fences 5 opposite one another and they can take the form of thin divider plates to form one or more compartments between the fences 4 and 6 thus permitting the collection of separate stacks side by side.

Figure 2:
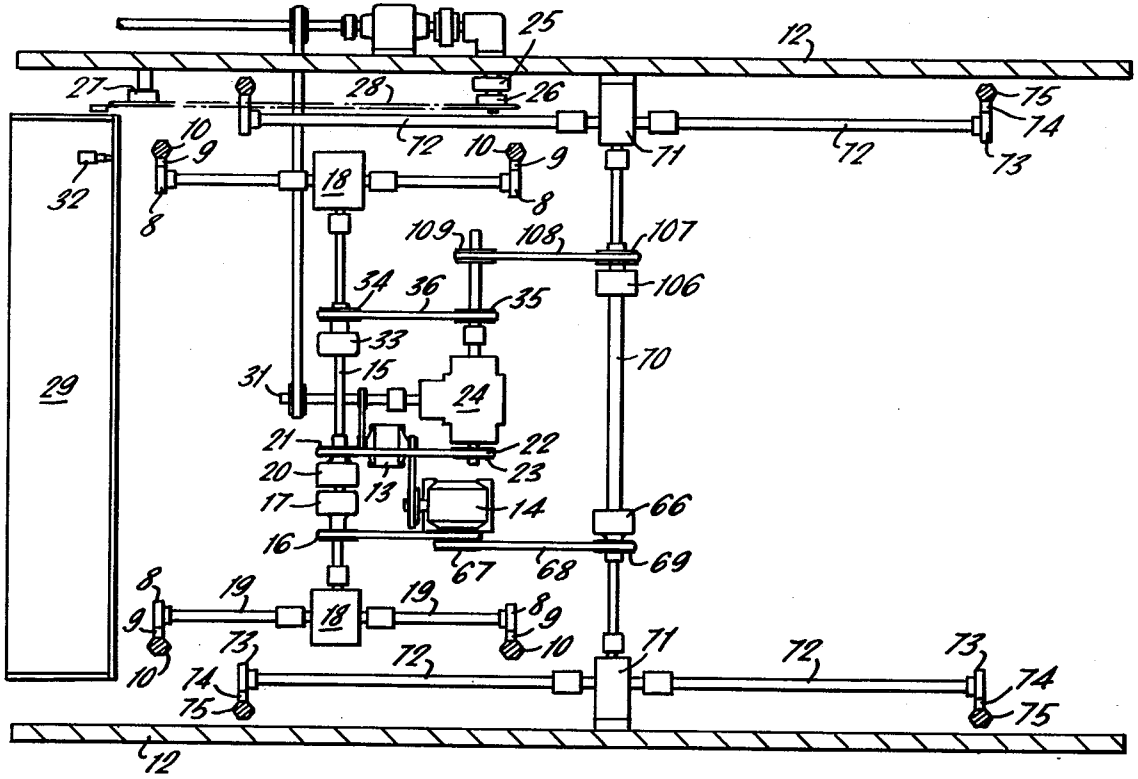
FIG. 2 is a plan view of the drive mechanism.

Vibration for jogging the fences 4, 5 and 6 can be applied by means not shown to assist the edge register of the sheets during the stacking operation. The lowermost member of the layboy takes the form of a sheet support table 7, which is vertically reciprocable by rotation of a shaft to which a gear 8 (FIG. 2) is affixed, rotation of this gear moves rack 9 in a vertical direction, this movement being constrained by guides 10 running in rollers 11, (FIG. 1), which are rotatably mounted on the main frame 12 of the machine. In the arrangement illustrated (FIG. 2), the drive for the machine is initiated by a rotary knife, not shown, which is producing sheet material from reel stock and delivering it to the layboy. The drive for the machine is transmitted from the knife to a layshaft, 31, and from the layshaft 31 to a speed variator 13, so that relative variation between the thickness of the sheets delivered to the layboy 3 and the descent rate of the table 7 can be accomodated. A drive from the output of speed variator 13 drives a reduction gearbox 14. A twin pulley 67 from the gearbox 14 is coupled to a drive shaft 15 on which a pulley 16 is engageable by means of a clutch 17. With the drive in operation, clutch 17 is energised which rotates a drive shaft 15 which in turn rotates gearboxes 18 which rotate the gears 8 by means of drive shafts 19, this propels the table 7 (FIG. 1) in a downward direction, at a rate commensurate with sheet delivery to the layboy. Clutch 17 is then de-energised, and clutch 20 energised which takes a drive from the layshaft 31 through gearbox 24 and pulleys 21 and 23 and the drive is transmitted by belt 22. This drive has no reduction and therefore drives the table 7 downward at a much greater descent rate than that of the product delivered to the layboy. The arrival of the table 7 in its lowermost position (see FIG. 1), operates a switch 24 which de-energises the clutch 20 thereby disconnecting vertical transmission to the table 7. Switch 24 also sends a signal to clutch 25 (FIG. 2) which when energised will drive a pusher 29 forward by means of sprockets 26 and 27 and chain 28, this transfers the contents of table 7 on to a conveyor 30, (FIG. 1), which is continuously running and driven by the knife shaft. At the end of its full outward stroke the pusher is returned by the chain, which passes over a sprocket and returned the pusher 29 to the original position. The restoration of the pusher 29 to its original position operates switch 32 (FIG. 2) which energises clutch 33, which takes up the drive through pulleys 34 and 35 and belt 36, this drives in the manner previously described through to gear 8 which elevates the table 7 at a fast speed. This upward movement is terminated when a lug 103 on the table 7 contacts a switch 104 on the descending auxiliary sheet support member 37 which, at that time, is supporting the stack within the layboy 3. Switch 104 sends a signal which de-energises clutch 33 and energises clutch 17 enables the table to once again descend at the growing rate of the stack.

By known devices, not shown, the number of sheets cut by a rotary knife or impressions from a printing machine can be registered so that after a pre-determined number of deliveries a control signal can be generated.

This signal is used to initiate mechanism to impel a divider on to the top of an edge or edges of a stack within the layboy between successive sheet deliveries to provide batches of sheets of, for example, a ream. One way of recording this counting operation will now be described.

A divider has the form of a horizontal bar provided with flexible thin fingers spaced at intervals along its length so that, in the ready to use condition, the rod is supported, with the fingers pointing generally upward, close to the outside of a layboy fence which has the form of vertical rails.

At the required count, the divider is rotated so that the fingers pass between the fence rails and flex on to the top of the stack within the layboy between successive sheet deliveries.

Figure 3:
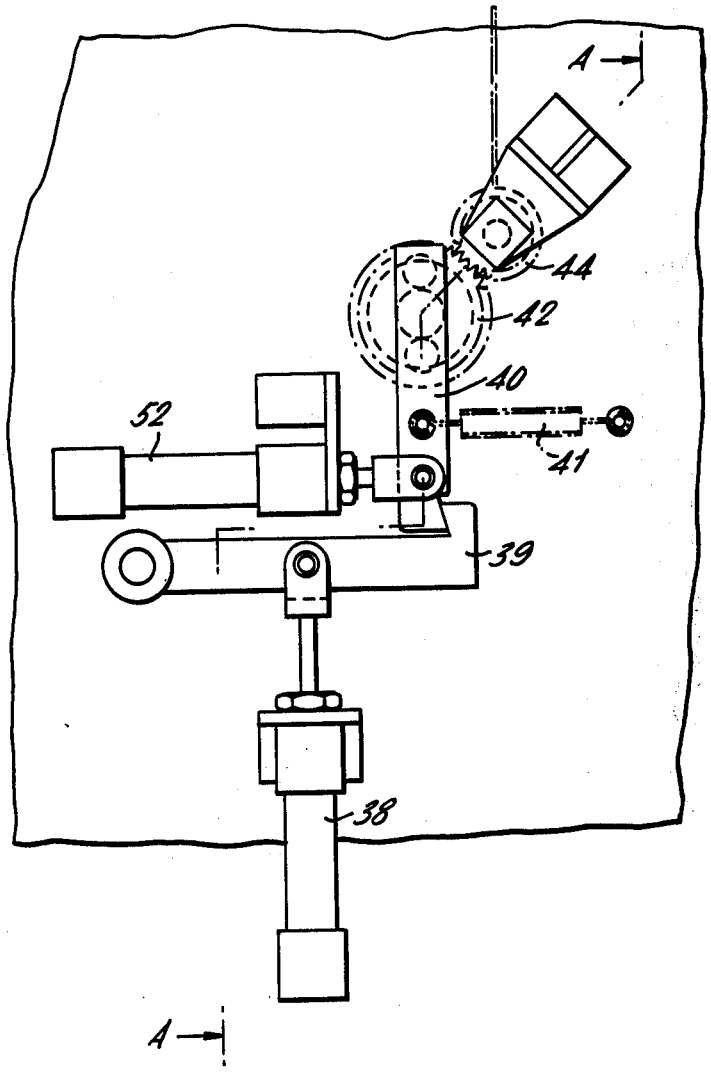
FIG. 3 is an elevation of the divider feeding mechanism.
Figure 4:
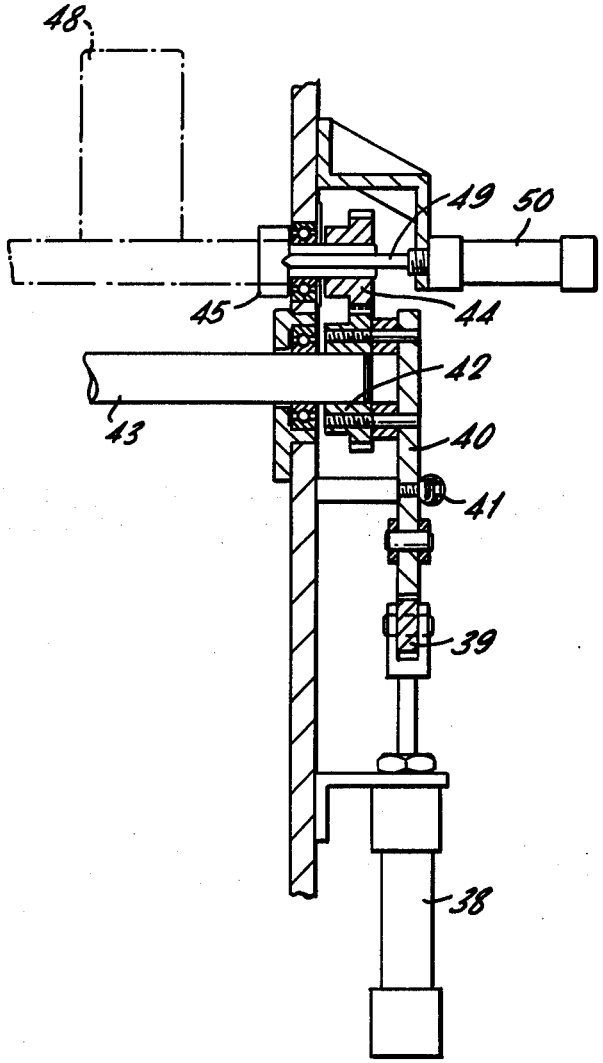
FIG. 4 is a section 'A'—'A' on FIG. 3.

Referring to FIGS. 3 and 4, at the required count registered by the sheet delivering machine a solenoid operated valve, not shown, is operated to select pressure air to the piston rod side of a cylinder 38, FIG. 3, which pulls down a latch 39 and releases a pawl 40 which under the influence of a tension spring 41 is induced to rotate about the axis of a gear 42 to which it is affixed. The gear 42 is duplicated on the opposite side of the machine and both gears are connected by a cross shaft 43, FIG. 4. The gears 42 mesh with gears 44 on both sides of the machine and the gears 44 are fixed to chucks 45, FIG. 4. Therefore when the pawl 40 is released, the action is such that chucks 45 on both sides of the machine are rotated in harmony. The chucks 45 are cylindrical members with cross slots and are located at the intersection of magazines 46, FIG. 6 and vertical guides 47, FIG. 6. Both ends of a divider 48 are shaped to form lugs which are located in the magazines 46 and subsequently chucks 45. When the chucks containing a divider rotate, the divider fingers are impelled between the rails of the fence 6 and on to the top of the stack within the layboy in the manner above described. It will be understood that the cross slots are now aligned with the vertical guides 47, and to prevent the horizontal bar from falling prematurely down the vertical guides a thrust pin 49, FIG. 4, concentrically located through one of the chucks 45 is loaded by an air cylinder 50, sufficient to overcome downward movement of the divider due to its own weight and the effect of the fingure flexure.

After a few sheet deliveried, the weight of the sheets will provide sufficient movement of the divider fingers to enable the thrust pin to be withdrawn by the air cylinder 50, thus permitting the divider to travel down with the growing stack. A switch 51, FIG. 6 detects that the divider has moved downward in the guides 47 sufficiently to clear the chucks 45 thus initiating the movement of a cylinder 52 (FIG. 3) against the action of spring 41, At the end of the stroke of the cylinder 52, the cylinder 38 is signalled to return the latch 39 to re-capture the pawl 40. In this condition, the cross slots in the chucks 45 are aligned with the magazines 46 and are ready to receive the next divider.

Figure 6:
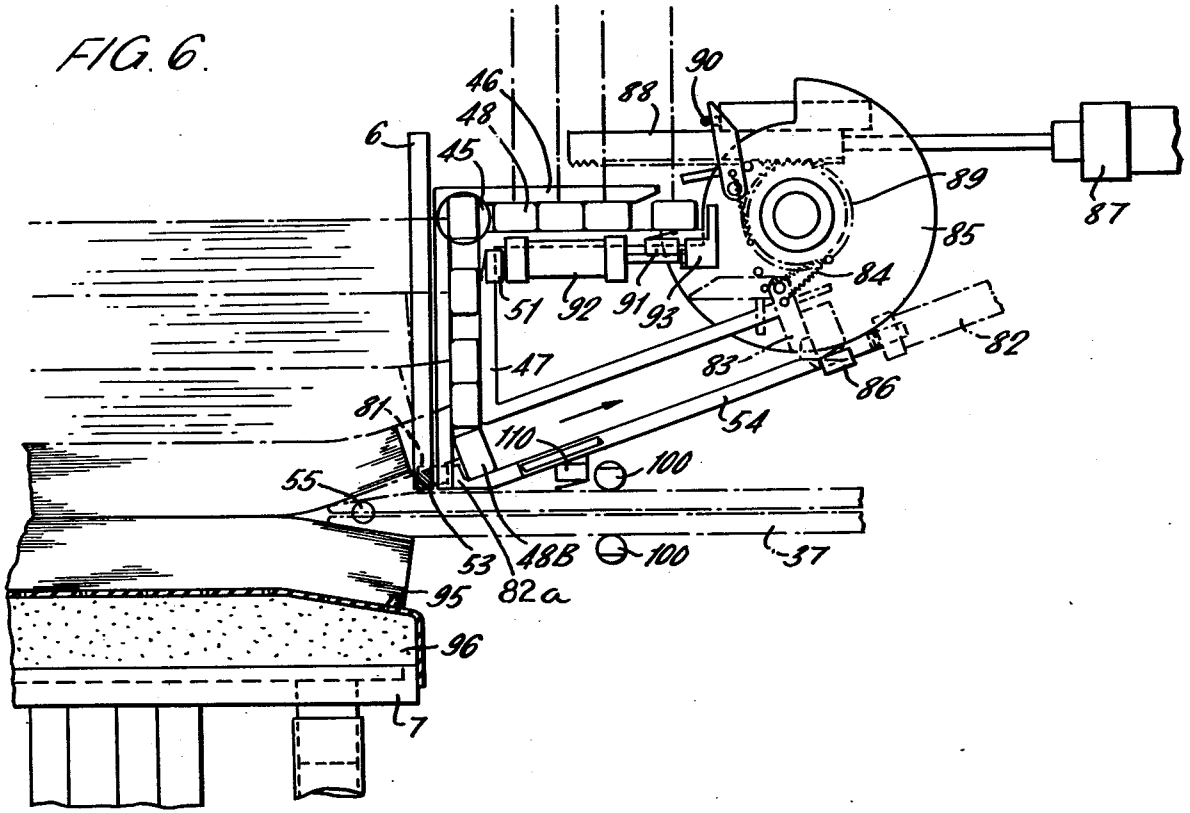
FIG. 6 illustrates a form of table, a divider insertion and retrieval mechanism.

After a divider has been inserted into the stack, it moves progressively downward at the growing rate of stack and is ultimately arrested by a crosshead 53, FIG. 6, which is located at the foot of the railed fence 6 and is supported by guide rails 54. As the stack continues to descend a gap is created between the underside of the fingers of the arrested divider 48B and the uppermost sheet of the batch of sheets on the table 7. A photo-electric light source and receiver 55 are beamed across the machine to detect the creation of this gap and when detected, to signal a solenoid valve not shown, controlling air supply to a cylinder 56 (FIG. 1). This cylinder, having received a signal from the solenoid valve, actuates a quadrant 57, which in turn rotates a gear 58 which is connected to a shaft 59 which spans the main frame 12 of the machine, the rotary motion is transmitted to discs 60, which are mounted each side of the machine, and fixed to the shaft 59, this motion is transmitted to a lever 61, by a sliding block 62. Lever 61 is connected by a link 63 to a carriage 64, this carriage is restrained by horizontal guides 65, providing a straight line motion for the auxiliary sheet support member 37 into the gap induced by the arrest of the divider 48B. The auxiliary sheet support member 37 travels forward into the stack and completely divorces the main stack within the layboy from the batch resting on the table 7.

Energisation of the clutch 66 (FIG. 2), takes up the slow speed drive from gearbox 14 through pulleys 67 and 69 and belt 68. This rotates drive shaft 70, Rotation of drive shaft 70 in turn rotates gearboxes 71 and drive shafts 72, affixed to drive shafts 72 are gears 73, which when rotated move racks 74 and guides 75 downward at the growing rate of stack within the layboy.

Guides 75 (FIG. 1) are mounted on a crosshead 76, The guides 75 run in rollers 77 which are rotatably mounted on the main frame 12. The guides support a slide track member 78 at both sides of the machine, along which the auxiliary sheet support member 37 is free to travel. Therefore, it will be seen that energisation of the electro-magnetic clutch 66 serves to lower the member 37 at the growing rate of stack within the layboy.

The member 37 carries a striker 79, FIG. 1, which on completion of the forward propulsion of the member 37 into the layboy, operates a switch 80 which in turn signals the de-energisation of clutch 17 and the energisation of clutch 20 so that the table 17 and the batch of sheets between the table and the member 37 are moved downward at a much higher speed than the growing rate of stack within the layboy now supported by the member 37. At the completion of the rapid upward travel of the table 7, a lug 103, strikes switch 104 thus initiating the change of direction and rate of travel of the table 7 in the manner above described. The solenoid valve, not shown, controlling the cylinder 56 is signalled to withdraw the member 37 from the layboy.

Complete withdrawal of the member 37 is achieved when level 61 depresses switch 105, (FIG. 1), this switch energises clutch 106, (FIG. 2), which takes up a drive from pulley 107 and 109 and belt 108, rotating drive shaft 70 to raise the member 37 rapidly. When the member 37 has travelled fully upwards, it operates a switch 110, (FIG. 6), which de-energises clutch 106. This switch is also interlocked with photo-electric cell and receiver 55, to ensure that the member 37 cannot travel forward until a clear signal from photo electrical cell 55, and A signal that switch 110 is depressed.

The auxiliary sheet support member 37 having reached this position has completed its cycle and is now ready to travel forward, given the signal situation described above.

During the forward travel of the member 37 (FIG. 6) it also operates a switch 81 which signals a solenoid valve, not shown, which directs air to the piston side of a cylinder 82, having a hooked arm 82*a* which gathers the divider 48B, and the divider is moved upwardly along guide bars 54, as the divider travels it strikes a lug on latch 83, the latch is moved as the divider 48B travels forward and under the tension of spring 84 grips the divider 48B, in the rotary disc 85, as shown in broken lines in FIG. 6, a similar disc being mounted on the other side of the machine. This is the magazine loader device which will now be described.

On entering the disc 85 the divider 48B operates a switch 86, which signals a solenoid valve, not shown, to direct air to the piston head side of cylinder 87. As the cylinder travels forward a rack 88, which is fixed to the cylinder rotates a gear 89, which is fixed to the discs 85. Rotation of the discs 85, cause latch 83 to strike release bar 90, this releases the grip on divider 48B, which has depressed switch 91, this switch signals a solenoid valve, not shown, to send pressure air to the piston rod side of a cylinder 92. This pulls divider 48B into the magazine 46, by means of pusher 93. Divider 48B is then held in magazine until chuck 45 is rotated, presenting a slot for divider 48B to enter as the dividers move along magazine 46, switch 91 is cleared and this signals a solenoid valve, not shown, which sends pressure air to the piston rod side of the cylinder 87, which reverses the previous motion and returns discs 85 to their original position. During the forward movement of discs 85, latch 83 in striking release bar 90 is taken over centre against the tension of spring 84, which holds latch 83 in the open position, ready to accept another divider, on its return to the original position.

To prevent the bottom sheet of a stack of paper sheets, particularly thin sheets, from adhering to table 7 whilst a batch is being transferred to the coneyor 30 a thin film of gas may be formed over the upper surface of the table 7. To this end, as shown in FIG. 6, the table 7 is hollow and the top is provided with a perforated top 95, between the table 7 and the perforated top 95. A porous compressible pad 96 can be provided, which is sealed around the edges to be air-tight. When the compressed gas enters the table 7 it passes through the pad 96, and the perforated top 95 to form a thin film on the upper surface of the pad. The pad 96 expands during withdrawal of the member 37 to take up the gap left by member 37 and act as a support for the stack as member 37 is withdrawn.

Figure 5:
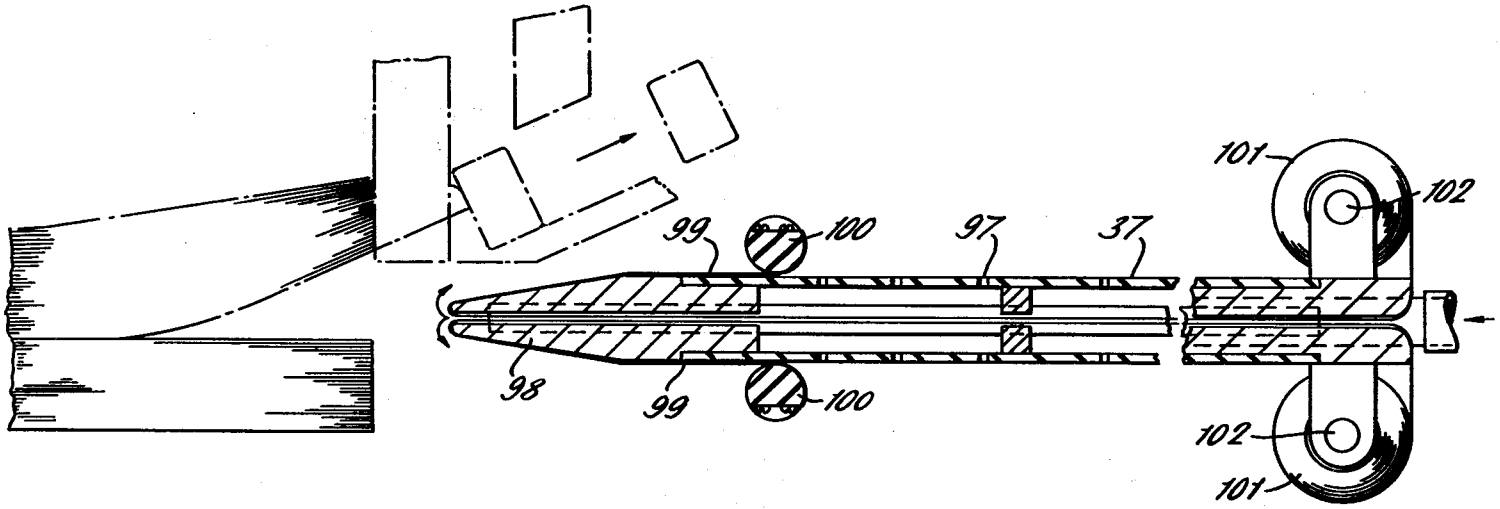
FIG. 5 illustrates a form of auxiliary sheet supporting member.

FIG. 5 shows the member 37 arranged to emit a current of gas, usually air at perforations 97, this produces a thin film of gas or air to enable the blinds 99 to pass smoothly over the member 37 and nose piece 98.

The blinds 99 are fixed to fixed bars 100, and it will be observed that as member 37 travels forward the top edge of the blind will remain stationery while the blind unwinds from the centre of the member 37, taking belt from the reel 101, which is sprung by means of a spring wound around the core 102 of the reel.

On the return travel of the member 37 the sprung reel 101 rewinds the blind 99, by virtue of the sprung core 102. The blind 99 and reel 101 and 102 are provided on the top and bottom of member 37, (FIG. 5).

What we claim is:

1. A layboy mechanism for the continuous stacking and delivery of batches of sheet material received from a delivery mechanism and comprising means for continuously assembling sheets into a downwardly moving stack, divider means downwardly movable with the stack for dividing the stack as it is formed into batches containing a predetermined number of sheets, auxiliary support means which move between an operative support position and an inoperative position clear of the stack, means for operating said divider means to cause an opening between the lowermost batch and a batch above it to enable the auxiliary support means to enter the stack at said opening, and means for removing said lowermost batch whilst the remainder of the stack above it is supported by said auxiliary support means.

2. A layboy mechanism as claimed in claim 1 in which the divider means includes a number of divider elements and divider element feeding and withdrawing means which operates to position a divider element on the top of said formed stack to define a batch and move downwards with it and to remove it when the batch below it is removed from the stack.

3. A layboy mechanism as claimed in claim 2 in which the divider elements are stored in a magazine from which they are fed by the feeding and withdrawing means.

4. A layboy mechanism as claimed in claim 3 in which each divider element comprises two or more thin fingers carried on a support member.

5. A layboy mechanism as claimed in claim 4 in which each divider element is carried in a magazine with the fingers pointing upwards and is rotated into a position in which the fingers lie on top of the stack to define a batch.

6. A layboy mechanism as claimed in claim 2 in which restraint means are provided at a predetermined position to restrain downward movement of each divider element with the stack to cause a gap to open in the side of the stack beneath the element to allow initial insertion of said auxiliary support means beneath the batch defined by the divider element.

7. A layboy mechanism as claimed in claim 2 in which the stack is formed by a support table reciprocable to and from an initial upper position at which the table is engageable with the bottom of the stack and a lower position from which the lowermost batch is removed, whilst the remainder of the stack is supported by the auxiliary support means, and means being provided for causing the support table to descend at a predtermined rate between the initial upper position and the position in which the stack above the lowermost batch is supported by the auxiliary support menas and to then descend at a greater predetermined rate until it reaches the lower position where the lowermost batch is removed.

8. A layboy mechanism as claimed in claim 7 in which the support table is provided with a thin film of gas or air over its upper surface.

9. A layboy mechanism as claimed in claim 8 in which the table comprises a perforated top carried on a porous compression pad which expands to take up the gap between the table and the auxiliary support means when said support means is withdrawn to allow the batch it is supporting to rest on the support table.

10. A layboy mechanism as claimed in claim 1 in which the auxiliary support means moves downwardly when in its operative support position at a predetermined speed in accordance with the rate of stack growth.

11. A layboy mechanism as claimed in claim 1 in which the auxiliary support means comprises a flat plate having a slot through which extend a pair of blinds, the end of the upper blind extending around the front upper edge of the plate and being secured in a fixed position on the device and the other end being carried on a rotatable reel around which part of the blind is wrapped, and the lower blind extending through the slot and around the front lower edge of the plate and its ends being secured into a similar manner to the upper blind, so that, when the plate moves towards its operative position the blinds unwind from the reels and upper and lower surfaces of the plate in the stack are covered by the blinds.

12. A layboy mechanism as claimed in claim 11 including means for blowing air or gas between the upper and lower surfaces of the plate and the adjacent surfaces of the blinds.

13. A layboy mechanism as claimed in claim 1 comprising a sheet receiver in which sheets are superimposed and stacked on a support table reciprocable to and from an initial position at which the table is engageable with the bottom of a stack contained in the receiver and a position directly below and in line with the receiver and from which a stack removed from the receiver is unloaded from the table, a divider element containing magazine, divider element feeding and withdrawing means operable to move a divider element from the magazine, to position it on the top of a stack contained in the receiver to define a batch having a predetermined number of sheets, and to return it to the magazine when the stack below it has been lowered from the receiver by the table, and auxiliary stack-supporting member reciprocable to and from a position at which it engages and supports the stack formed of batches in the receiver while the table is being moved from a receiver to the unloading position and is returned to the initial position thereof, and actuating means operable to control operation of the support table, the divider element feeding and withdrawing means, and the auxiliary stack-supporting member in response to signals from a sheet counter device arranged to count sheets being delivered to the receiver, said actuating means being arranged while the support table and the auxiliary stack-supporting member respectively act as the support for sheets delivered to the receiver to permit downward movement of said table and member at the rate at which sheets are received by the receiver.

14. A layboy mechanism as claimed in claim 1 in which restraint means are provided at a predetermined position to engage each divider means and restrain downward movement of each divider means with the stack to cause an opening in the side of the stack between the lowermost batch and a batch above it in order to allow said auxiliary support means to enter and support the remainder of the stack whilst said lowermost batch is being removed.

15. A layboy mechanism as claimed in claim 14 in which the stack is formed by a support table reciprocable to and from an initial upper position at which the table is engageable with the bottom of the stack and a lower position from which the lowermost batch is removed whilst the remainder of the stack is supported by said auxiliary support means.

16. A layboy mechanism as claimed in claim 15 in which said auxiliary support means moves downwardly when in its operative support position at a predetermined speed in accordance with the rate of stack growth.

17. A layboy mechanism as claimed in claim 16 in which the divider means includes a number of divider elements and divider element feeding and withdrawing means which operates to position a divider element on the top of said formed stack to define a batch and move downwards with it and to remove it when the batch below it is removed from the stack.

* * * * *